US007822370B2

(12) United States Patent
Himes

(10) Patent No.: US 7,822,370 B2
(45) Date of Patent: Oct. 26, 2010

(54) TONER CARTRIDGE

(76) Inventor: William D. Himes, 4752 Schooner Blvd., Suffolk, VA (US) 23435

( * ) Notice: Subject to any disclaimer, the term of this patent is extended or adjusted under 35 U.S.C. 154(b) by 0 days.

(21) Appl. No.: 11/652,402

(22) Filed: Jan. 11, 2007

(65) Prior Publication Data

US 2007/0183815 A1 Aug. 9, 2007

Related U.S. Application Data

(60) Provisional application No. 60/758,634, filed on Jan. 13, 2006.

(51) Int. Cl.
*G03G 15/08* (2006.01)

(52) U.S. Cl. ..... 399/260; 399/263

(58) Field of Classification Search ..... 399/260, 399/262, 263

See application file for complete search history.

(56) References Cited

U.S. PATENT DOCUMENTS 4,650,097 A * 3/1987 Hagihara et al. ..... 399/260 X
5,835,827 A 11/1998 Kishimoto
6,229,976 B1 5/2001 Kimura
6,510,306 B2 * 1/2003 Ashikari ..... 399/260 X
6,856,779 B2 * 2/2005 Ota et al. ..... 399/262
6,950,621 B2 9/2005 Himes
6,980,755 B2 12/2005 Numagami
7,088,943 B2 * 8/2006 Iikura et al. ..... 399/260
7,187,876 B2 * 3/2007 Ito et al. ..... 399/260 X
2006/0008299 A1 1/2006 Amano et al.
2006/0013621 A1 1/2006 Kimura et al.

OTHER PUBLICATIONS

Front page of corresponding PCT publication WO 2007120369, International Search Report and IPPR (9 pages).

* cited by examiner

*Primary Examiner*—Sandra L Brase
(74) *Attorney, Agent, or Firm*—Cooley LLP

(57) ABSTRACT

The invention provides toner cartridges that deliver toner in a metered fashion to an image forming apparatus. The cartridges have a delivery mechanism comprising a toner delivery member that delivers toner to the supply port as it is rotated. Depending upon the orientation of the delivery mechanism, the toner delivery member can at least partially block or at least partially allow the free flow of toner out of the supply port, as desired. The delivery mechanism of the invention can be used to deliver toner, developer, or any such powder out of a container.

33 Claims, 21 Drawing Sheets

TONER CARTRIDGE

CROSS-REFERENCE TO RELATED APPLICATION

This application claims the benefit of U.S. Provisional Patent Application No. 60/758,634, filed on Jan. 13, 2006, which is incorporated herein by reference.

FIELD OF THE INVENTION

The invention relates to toner cartridges for use with an image forming apparatus.

BACKGROUND OF THE INVENTION

An image forming apparatus such as a copying machine contains a replaceable toner cartridge that supplies toner to the apparatus through a toner supply port in the cartridge. Because of the agglutinous texture of the toner, many cartridges contain both rotary mixers to ensure mixing and even distribution of the toner within the cartridge as well as an auger or other delivery mechanism that delivers toner to the toner supply port. Toner that is delivered to the toner supply port is pushed, pulled, or falls by gravity, through the supply into an adjacent port in the image forming apparatus. However, because standard augers do not seal the supply port, toner can leak through the supply port and into the apparatus, thereby delivering toner in an unregulated fashion. Excess toner can result in toner overload, clogging of the apparatus, a decrease in image quality, and/or apparatus failure. Some cartridge systems have attempted to address this problem, such as cartridges described in U.S. Pat. No. 6,229,976; U.S. Pat. No. 6,091,920; U.S. Pat. No. 6,128,453; and U.S. Pat. No. 6,542,709, but these devices require additional seal or gear components that are prone to failure or do not provide a consistent amount of toner. As a result, the quantity of toner being delivered to the machine is not consistent, making the cartridges on the market unreliable.

A need therefore exists for a toner cartridge that provides a reliable and consistent supply of toner to an image forming apparatus at an optimum and steady feed rate, while preventing the free flow of toner out of the toner supply port of the cartridge.

SUMMARY OF THE INVENTION

In one aspect, the invention provides toner cartridges that deliver toner in a metered fashion to an image forming apparatus. The cartridges have a delivery mechanism that delivers toner to the supply port and, depending upon the orientation of the delivery mechanism, can substantially block or substantially allow the free flow of toner out of the supply port, as desired. The delivery mechanism of the invention can be used to deliver toner, developer, or any such powder, or granular, or particulate matter out of a container. The invention eliminates problems faced by cartridges of the prior art, for example, it eliminates build up of toner on top of plate-like regulation members (e.g., U.S. Pat. No. 6,229,976) and provides better regulation of the flow of toner out of the container than cartridges with wing or paddle-like members (e.g., U.S. Pat. No. 5,185,631), better regulation of the volume of toner, a higher volume of toner per single rotation, less restriction of the flow of toner, and a requirement for less rotation per volume of toner delivered.

In an embodiment, the toner cartridge comprises a toner container, a supply port through which toner is supplied to an imaging apparatus, and a delivery member for delivering toner to the supply port. In an embodiment, the toner cartridge comprises an elongated container comprising a trough for containing toner, a lid, and a supply port for delivering toner to an image forming apparatus. The supply port can be located on the bottom or any side of the container, at any point along the length of the container, e.g., an end portion or a center portion. In an embodiment, the trough of the container also comprises a well for containing the delivery member.

In an embodiment, the delivery member comprises an auger, screw, or other rotating shaft capable of moving toner in the direction of the supply port. In another embodiment, the delivery member comprises a shaft with protrusions that propel toner in the direction of the supply port when the delivery member is rotated.

The delivery member of the invention has a toner feeding member that is shaped to at least partially prevent toner from passing through the supply port when in a first orientation but to at least partially allow toner to pass through the supply port when in a second orientation. In a preferred embodiment, the toner feeding member substantially prevents toner from passing through the supply port when in a first orientation but substantially allows toner to pass through the supply port when in a second orientation. In an embodiment, the toner feeding member is positioned adjacent to or opposite the supply port. In an embodiment, the toner feeding member comprises at least one circumferentially disposed side wall. In another embodiment, the toner feeding member comprises an end wall.

In an embodiment, the side wall comprises a pocket(s) that holds a volume of toner. The pocket is sized to obtain an optimum feed rate for supplying a volume of toner to the apparatus. For example, the optimum feed rate may be based upon the number of revolutions per second and the volume of toner held by the pocket. The optimum volume of the pocket is about 0.1 $cm^3$ to about 1.0 $cm^3$. In another embodiment, the pocket holds an amount of toner that is about 10% of an optimum pocket volume to about 250% of an optimum pocket volume, i.e., from about 0.01 $cm^3$ to about 4.0 $cm^3$.

In another embodiment, the toner feeding member comprises at least one channel that passes through at least a portion of the diameter of the delivery member, through which toner can pass into the toner supply port when the delivery member is in an open position but restrains the toner from passing when in a closed position. The toner feeding member may have one or more side walls. In yet another embodiment, the toner feeding member comprises at least one blade and one channel that passes through at least a portion of the diameter of the delivery member. The shape of the toner feeding member may be any shape that at least partially or substantially can block the supply port, for example it may be substantially planar, curved, polygonal, cubic, semi-spherical, semi-cylindrical or semi-conical. The toner feeding member is adjacent the toner supply port, so may be located on an end portion, on a central portion, or anywhere along the length of the delivery member, depending upon the location of the toner supply port.

In another embodiment, the toner cartridge further comprises a stirring member for stirring the toner in the cartridge. The stirring member and the delivery member may have separate gear mechanisms or may have a common gear mechanism, wherein the stirring member and delivery member gears engage with each other for simultaneous movement of the stirring member and the delivery member by rotation of only one of the stirring member or delivery member. The toner cartridges of the invention may also have a movable slide disposed over the toner supply port that blocks release of the toner from the toner cartridge when in a closed position but that allows release of the toner from the toner cartridge when in an open position.

In another aspect, the invention provides a novel delivery member comprising at least one side wall, pocket, channel and/or blade for use in any toner cartridge that requires delivery of toner to an apparatus through a supply port.

In yet another aspect, the invention provides methods for making and using a toner cartridge and/or a delivery member of the invention, as described herein.

BRIEF DESCRIPTION OF THE DRAWINGS

The foregoing and other objects, features and advantages of the present invention, as well as the invention itself, will be more fully understood from the following description of preferred embodiments when read together with the accompanying drawings, in which.

DETAILED DESCRIPTION OF THE INVENTION

Figure 1:
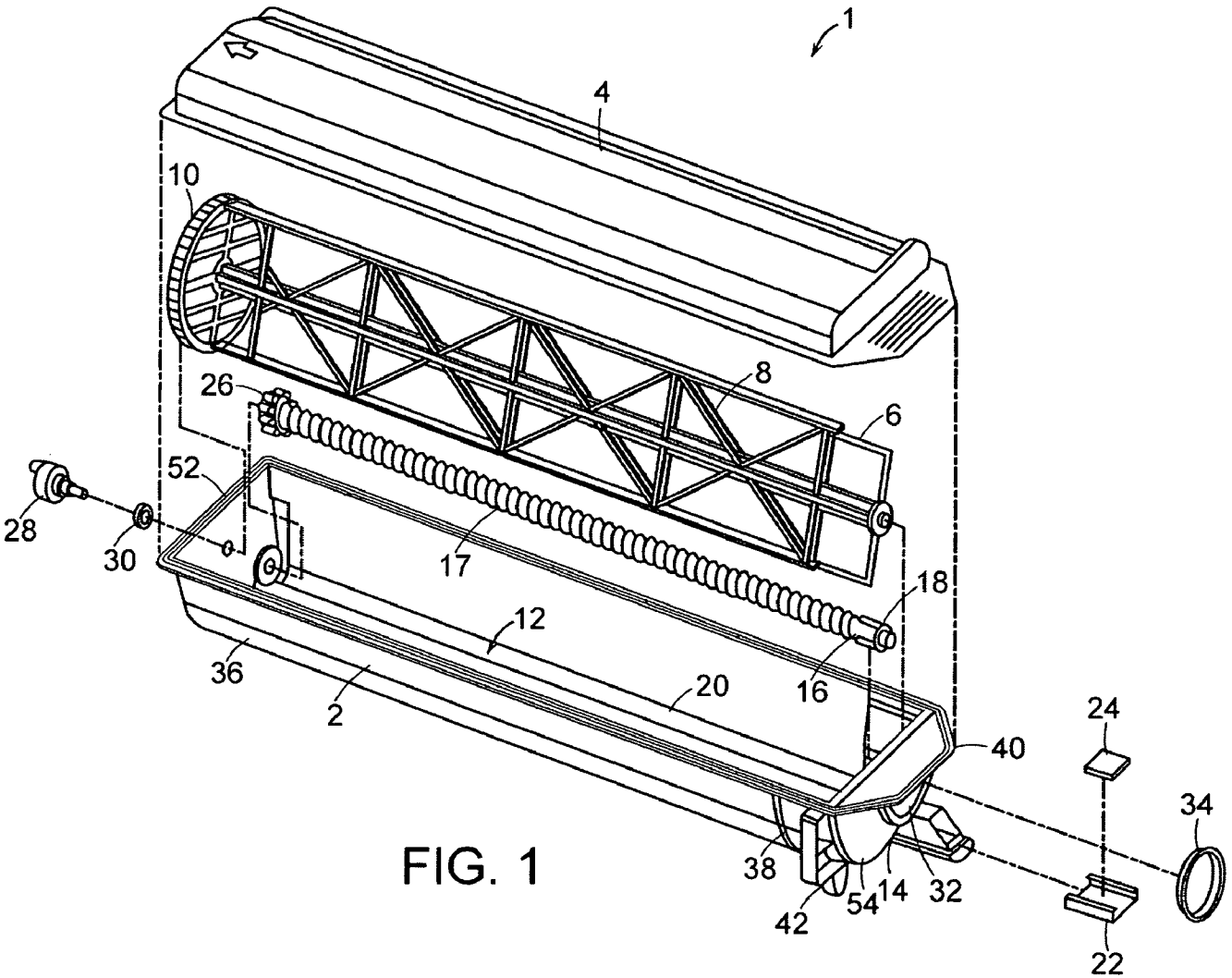
FIG. 1 provides an exploded view of an embodiment of a toner cartridge of the invention.
Figure 2A:
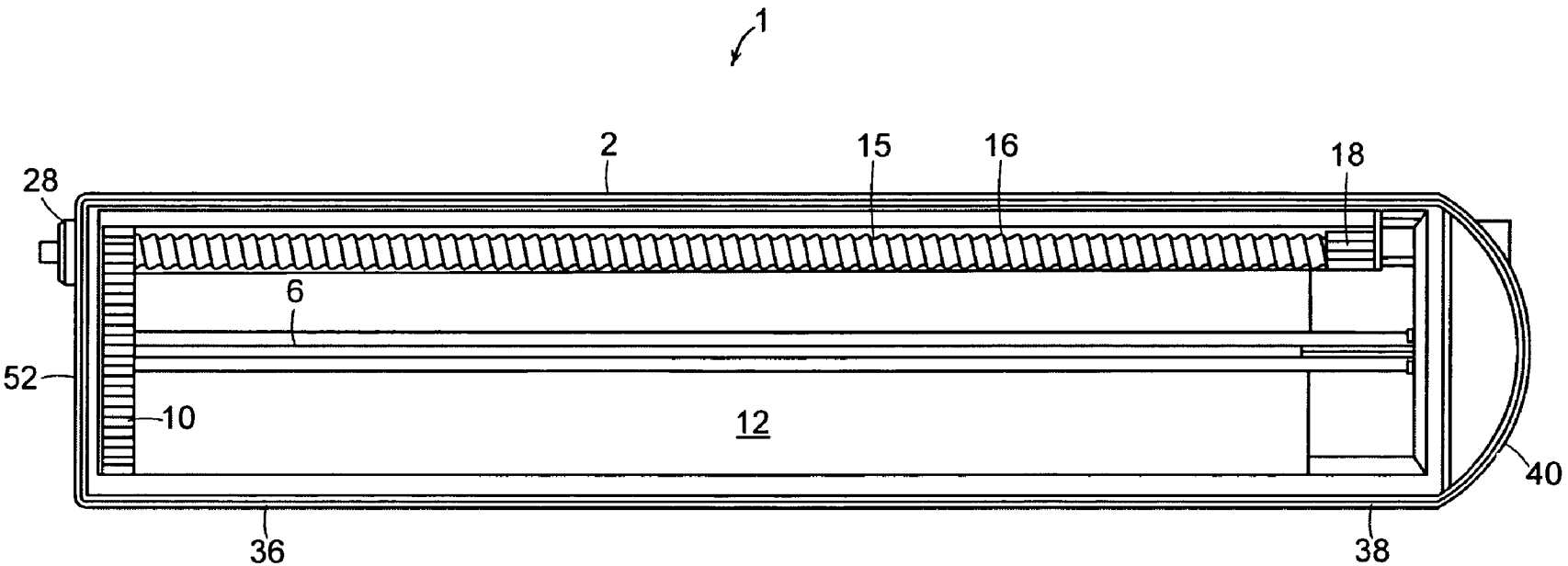
FIG. 2A provides a top view of an embodiment of a toner cartridge of the invention, with the lid removed.
Figure 2B:
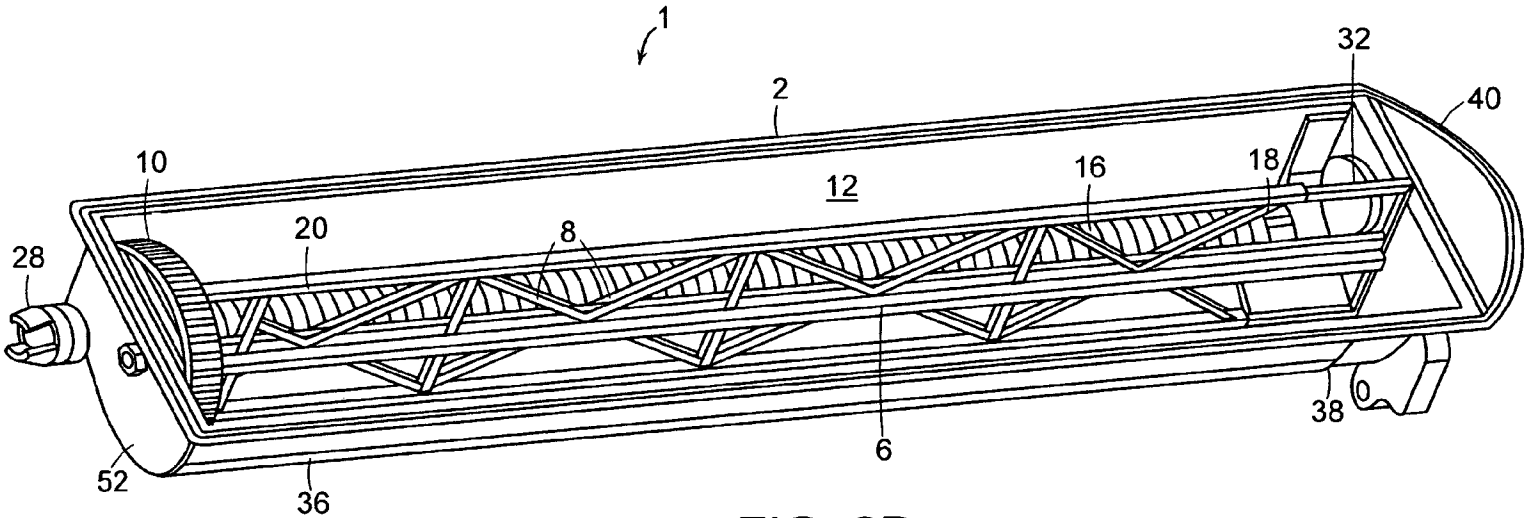
FIG. 2B provides a top perspective view of the embodiment of a toner cartridge shown in FIG. 1.
Figure 2C:
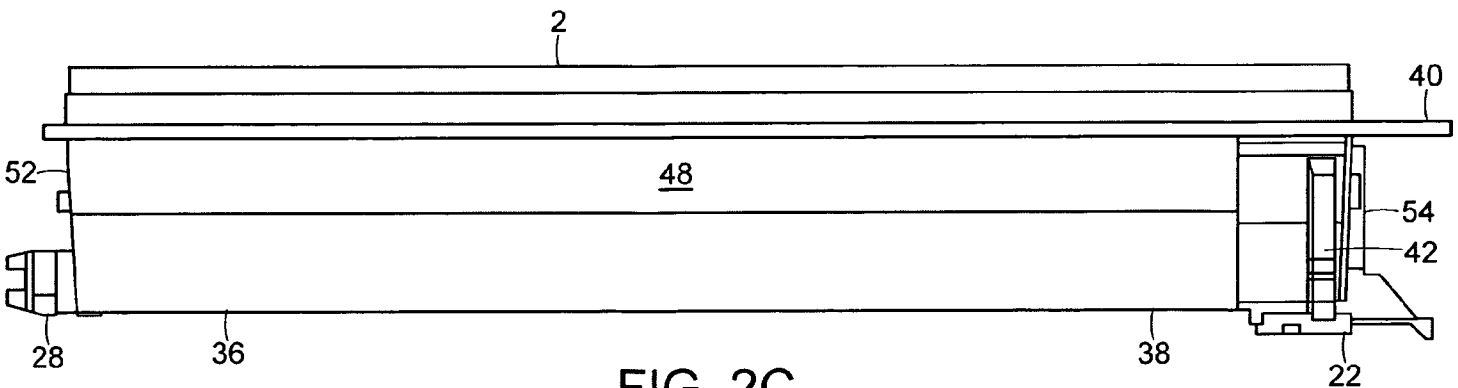
FIG. 2C provides a first side view of the embodiment of a toner cartridge shown in FIG. 1.
Figure 2D:
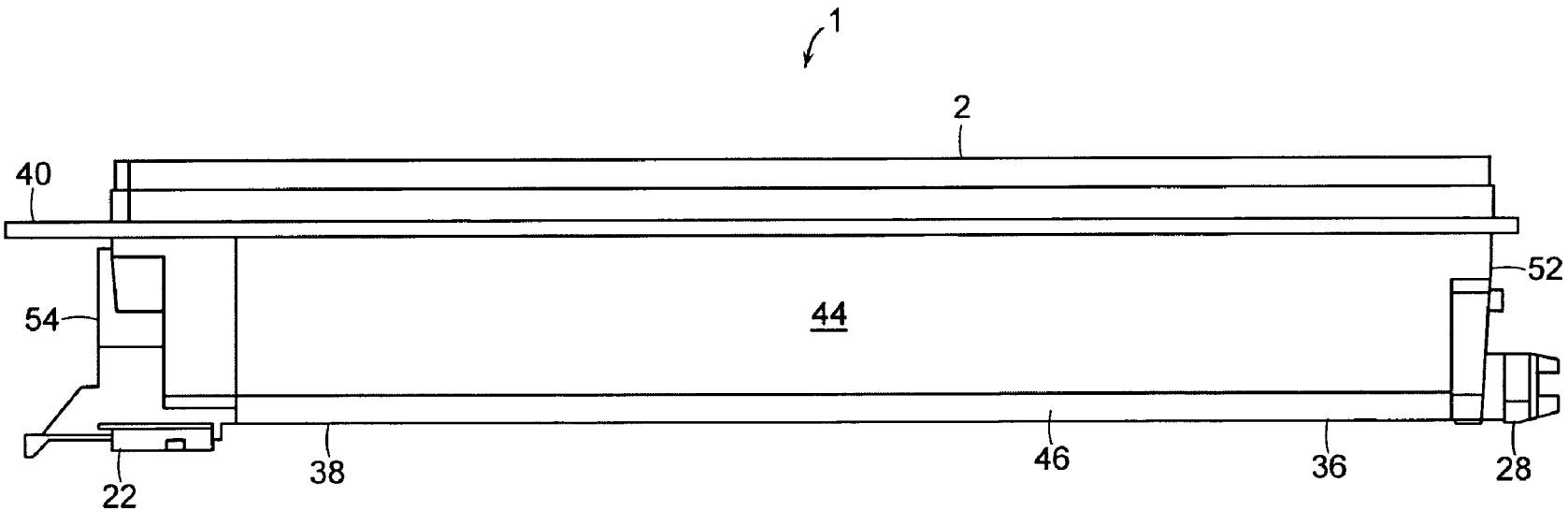
FIG. 2D provides a second side view of the embodiment of a toner cartridge shown in FIG. 1.
Figure 2E:
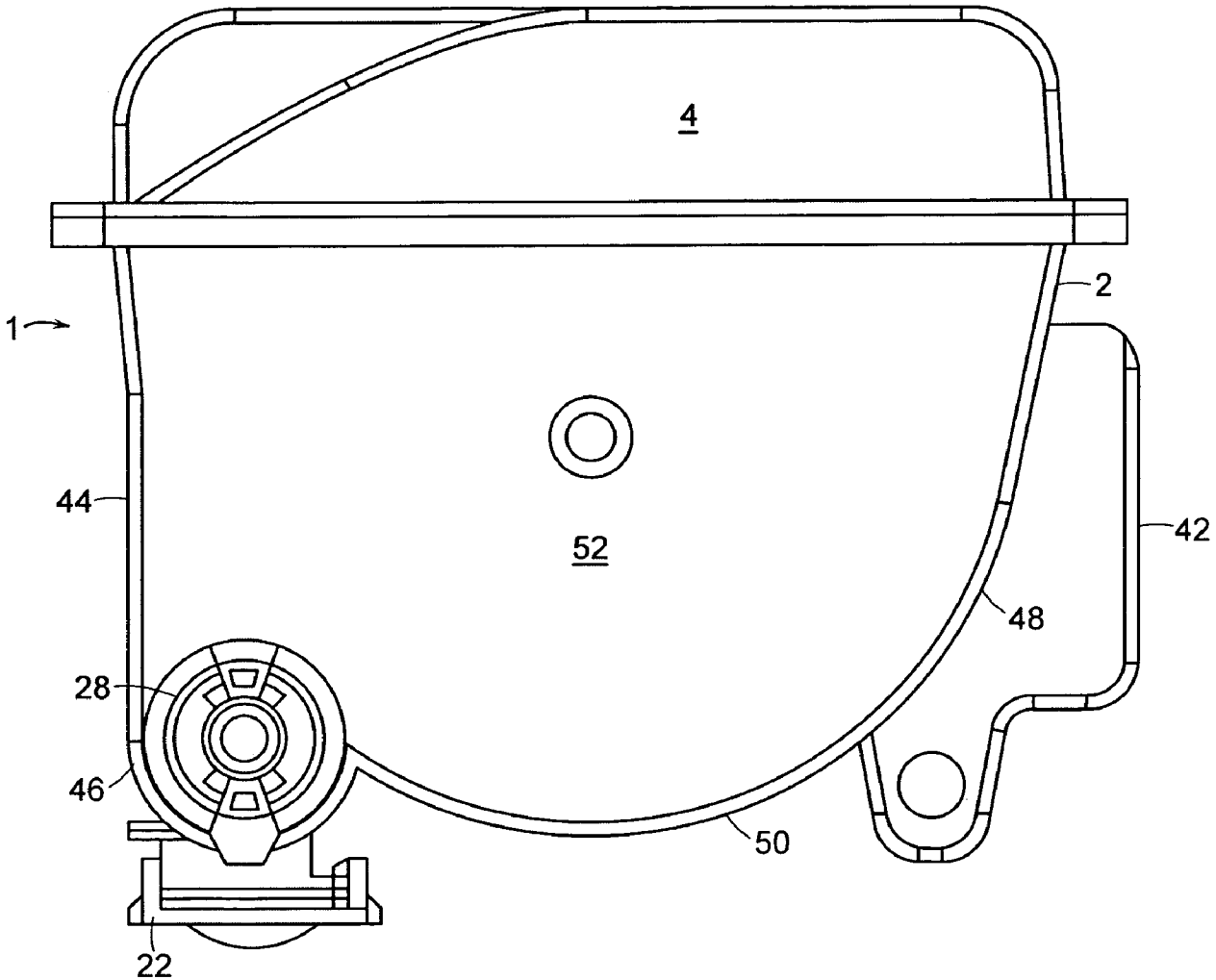
FIG. 2E provides a first end view of the embodiment of a toner cartridge shown in FIG. 1.
Figure 2F:
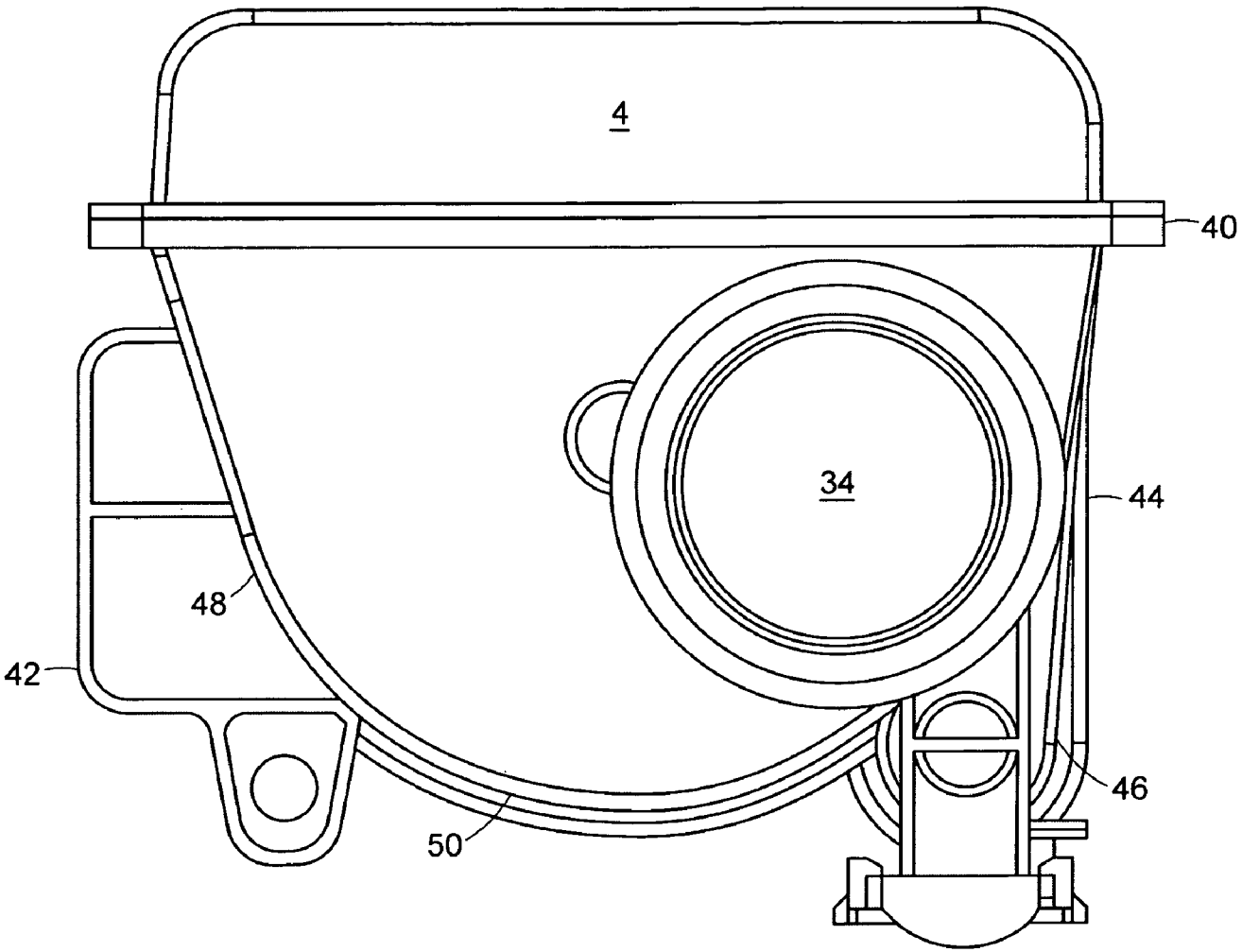
FIG. 2F provides a second end view of the embodiment of a toner cartridge shown in FIG. 1.
Figure 2G:
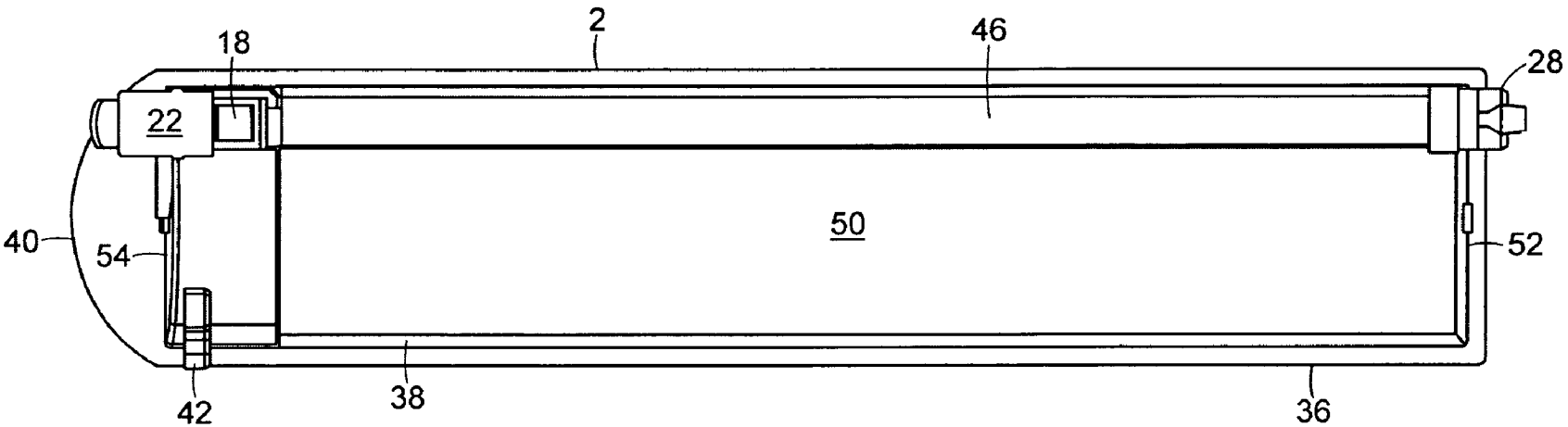
FIG. 2G provides a bottom view of the embodiment of a toner cartridge shown in FIG. 1.
Figure 2H:
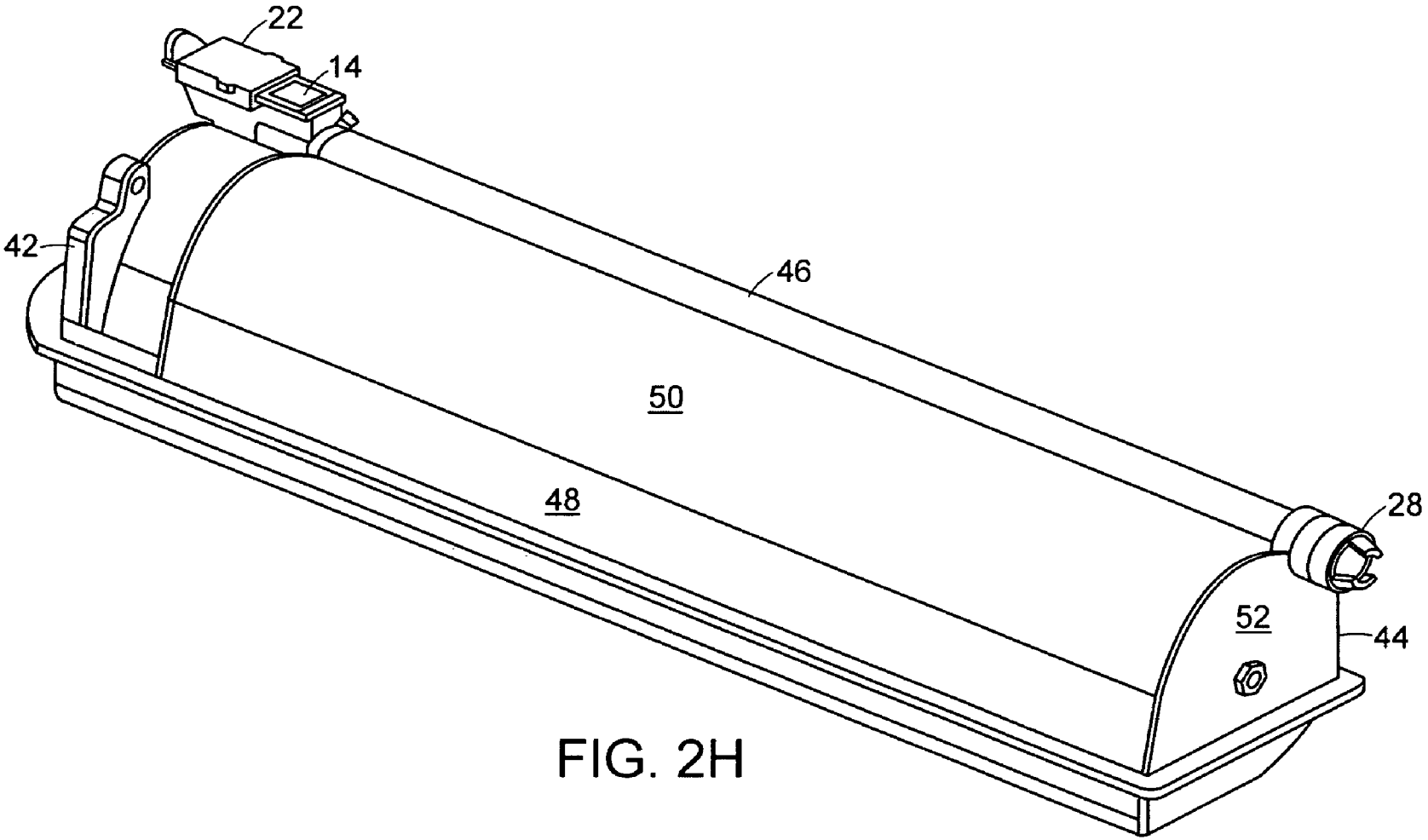
FIG. 2H provides a bottom perspective view of the embodiment of a toner cartridge shown in FIG. 1.
Figure 3A:
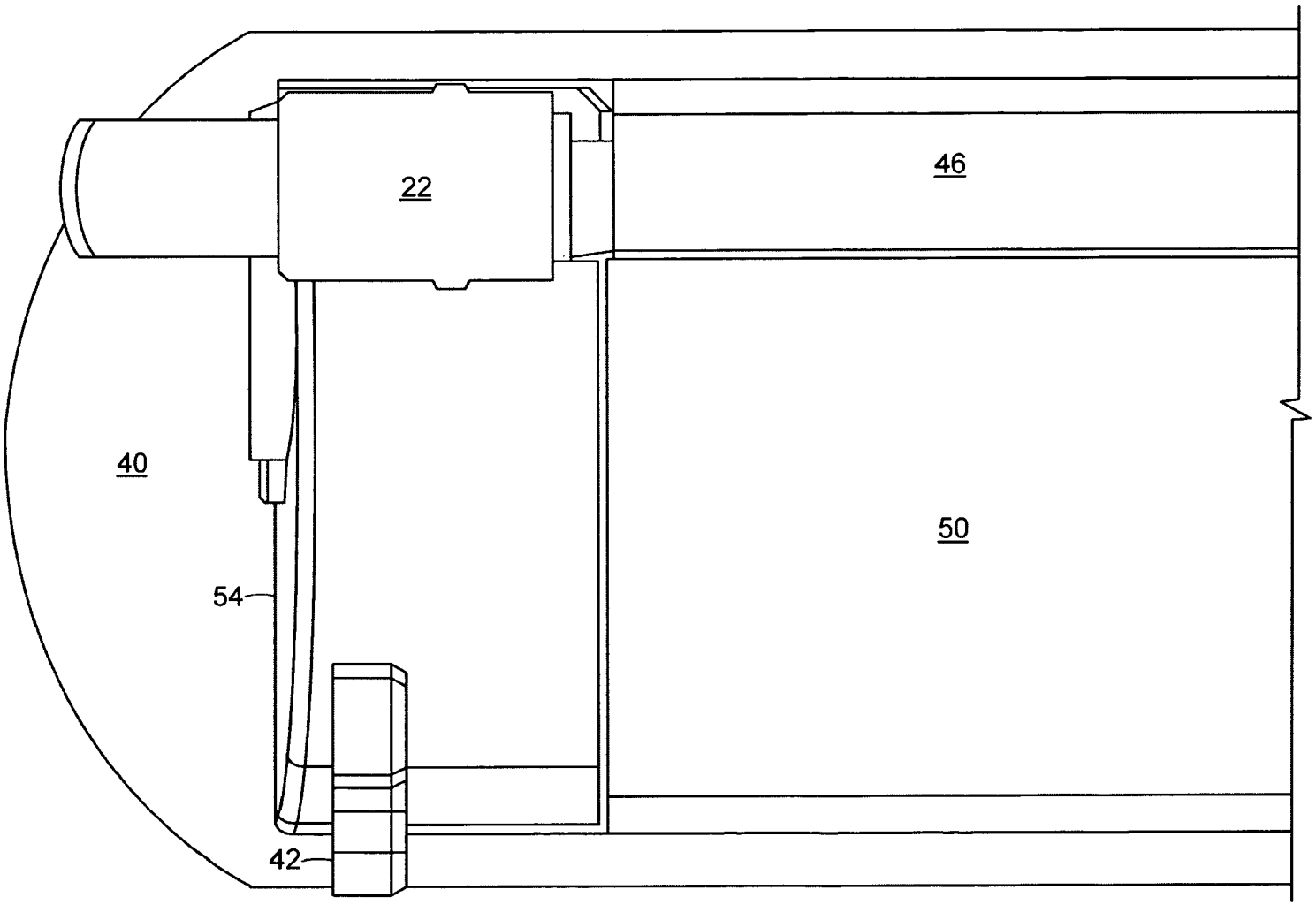
FIG. 3A provides a bottom view of a portion of the embodiment of a toner cartridge shown in FIG. 1 with the slide in a closed position.
Figure 3B:
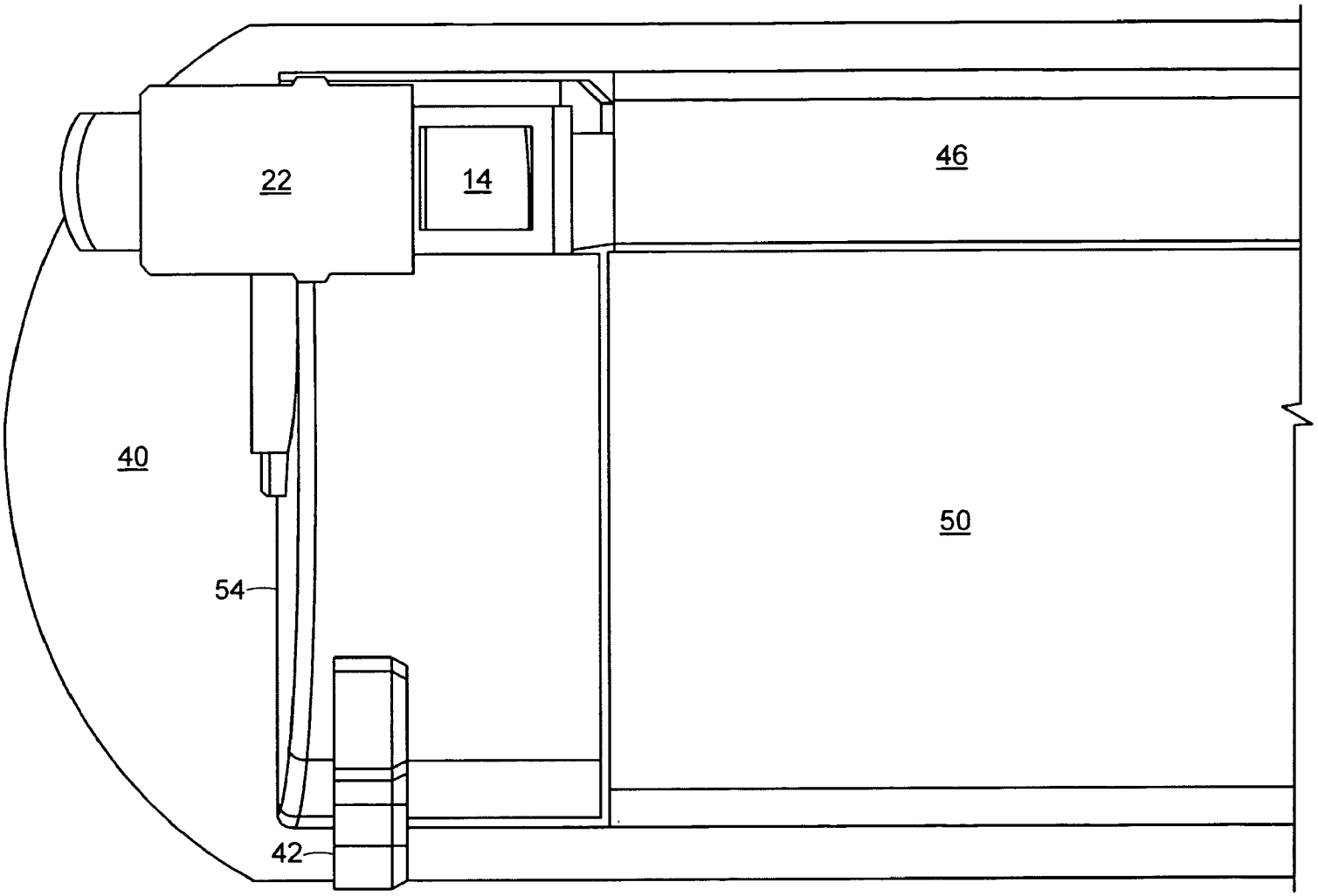
FIG. 3B provides a bottom view of a portion of the embodiment of a toner cartridge shown in FIG. 1 with the slide in an open position.
Figure 4:
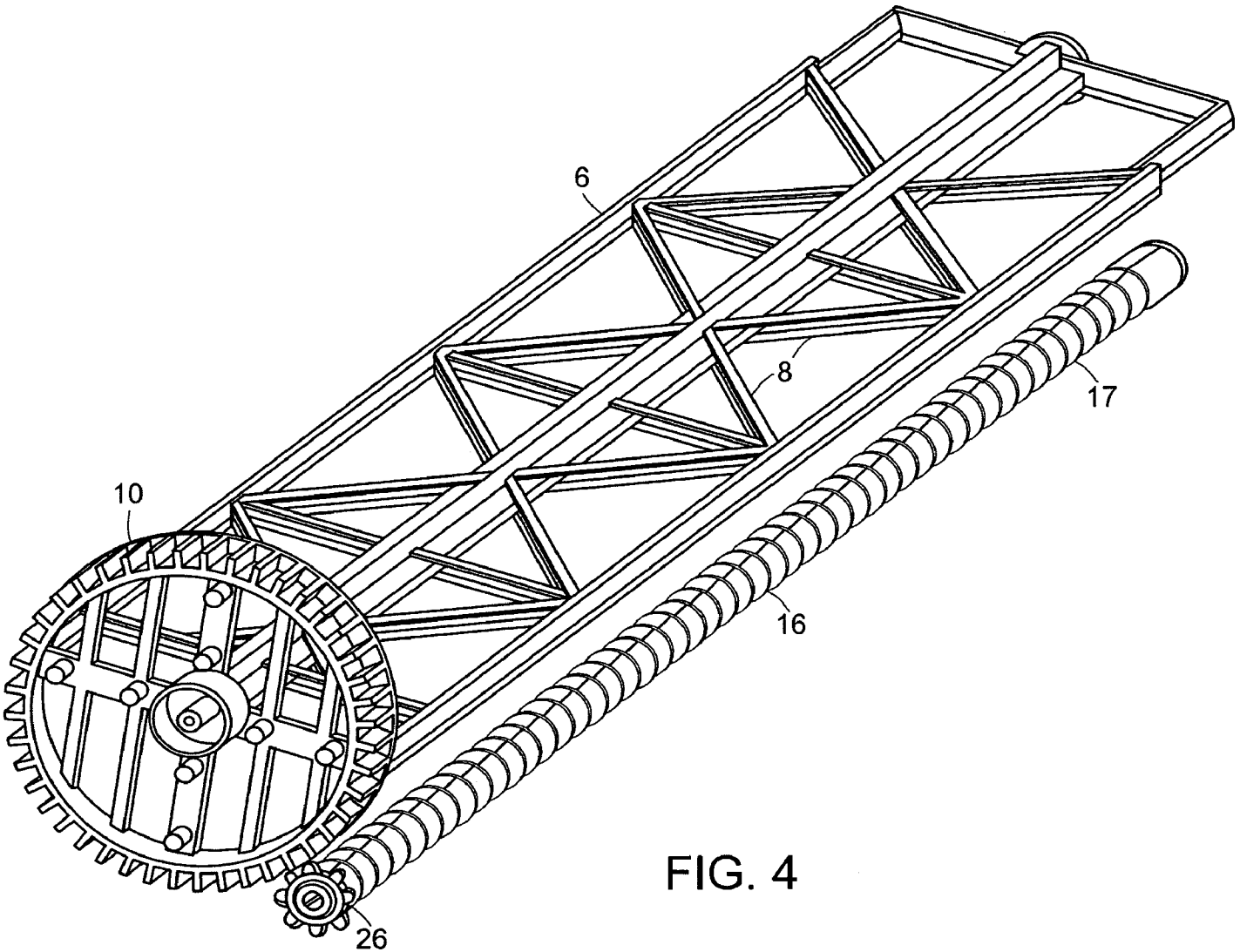
FIG. 4 provides a perspective view of a delivery member engaged with a stirring member.

Referring to FIGS. 1-2H, a toner cartridge 1 is shown comprising an elongated container 2, a lid 4, and a stirring member 6 longitudinally pivotally mounted in the container 2. The stirring member 6 comprises a plurality of diagonal mixing blades 8, and a driving gear 10 provided at a first end thereof. The container 2 has an elongated supply trough 12 longitudinally disposed therein and in communication with a supply port 14 through which toner is discharged. A delivery member 16 is mounted in the supply trough 12 and feeds the toner to the supply port 14 by rotation. The delivery member 16 has a central shaft 15, a helical feeding blade 17 and a toner feeding member 18 that both partially or substantially blocks the supply port 14 when facing in an closed orientation and delivers a metered amount of toner through the supply port 14 when facing in a closed orientation. In an embodiment, the delivery member 16 is disposed within a well 20 that is longitudinally disposed within, adjacent, or is otherwise is communication with the supply trough 12. Referring to FIG. 3A, 3B, a slide 22 and slide gasket 24 are disposed below the supply port 14. The slide 22 moves axially along the well 20 to close/open the supply port 14. A driving gear 26 is provided at a first end of the delivery member 16, which engages with the driving gear 10 of the stirring member 6 such that rotation of one of the delivery member 16 or the stirring member 6 results in rotation of the other (FIG. 4). A drive 28 and drive gasket 30 are disposed on the outside of end wall 52 of the container 2 and joined to the gear 26 of the delivery member 16, which is axially disposed through the wall 52. An opening 32 for filling the cartridge 1 with toner and a plug 34 for sealing the opening after filling the cartridge 1 with toner are disposed in the opposite wall 54.

FIGS. 2A-2H illustrate different views of an embodiment of the invention. In this embodiment, the toner cartridge 1 of the invention comprises additional features that allow the toner cartridge 1 to mate with an appropriate image forming apparatus. For example, referring to FIGS. 2A-2D, the toner cartridge has a first end portion 36 and a second end portion 38, wherein the second end 38 comprises a handle 40 used for inserting and removing the cartridge 1. The handle 40 may have any convenient shape, e.g., a curved shape or a tapered shape. Referring to FIGS. 2E and 2F, the container 2 of the toner cartridge 1 of the invention has a substantially arcuate shape and contains a flange 42 useful for removing the toner cartridge 1 from the imaging apparatus. For example, when removing the spent toner cartridge 1 from the imaging apparatus, a lever on the apparatus is rotated, which has a cam that contacts flange 42 and pushes the cartridge 1 out of the apparatus (not shown). Still referring to FIGS. 2E and 2F, the container 2 includes a straight side portion 44 leading to a partially cylindrical portion 46 (formed by the exterior of the well 20), a curved side portion 48 and a curved bottom portion 50. The first container end 52 and second container end 54 are substantially flat and have a substantially constant width that decreases toward the bottom 50.

Figure 5A:
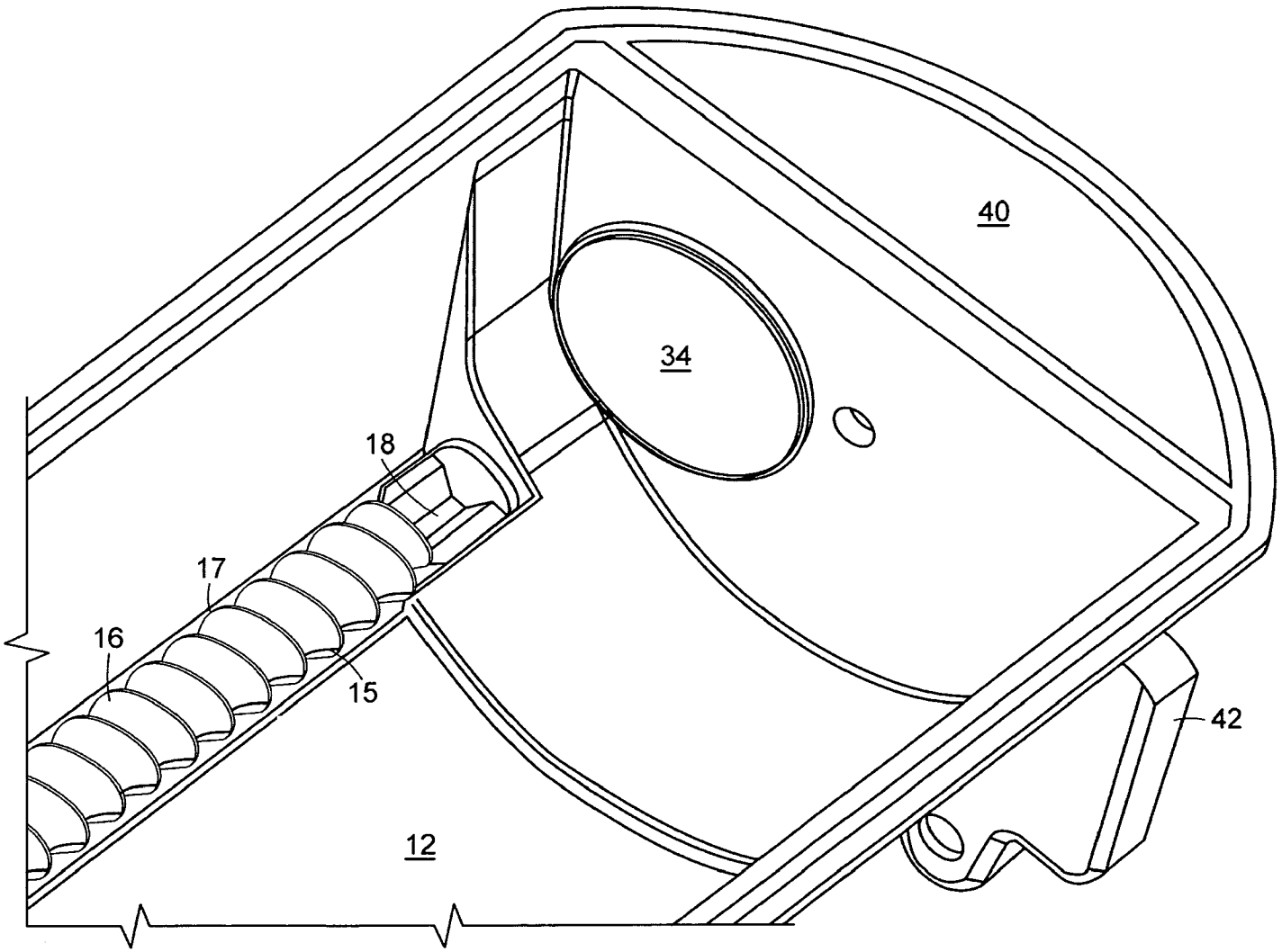
FIG. 5A provides a perspective view of a portion of an embodiment of a toner cartridge with the delivery member in place and the pocket in an upward position.
Figure 5B:
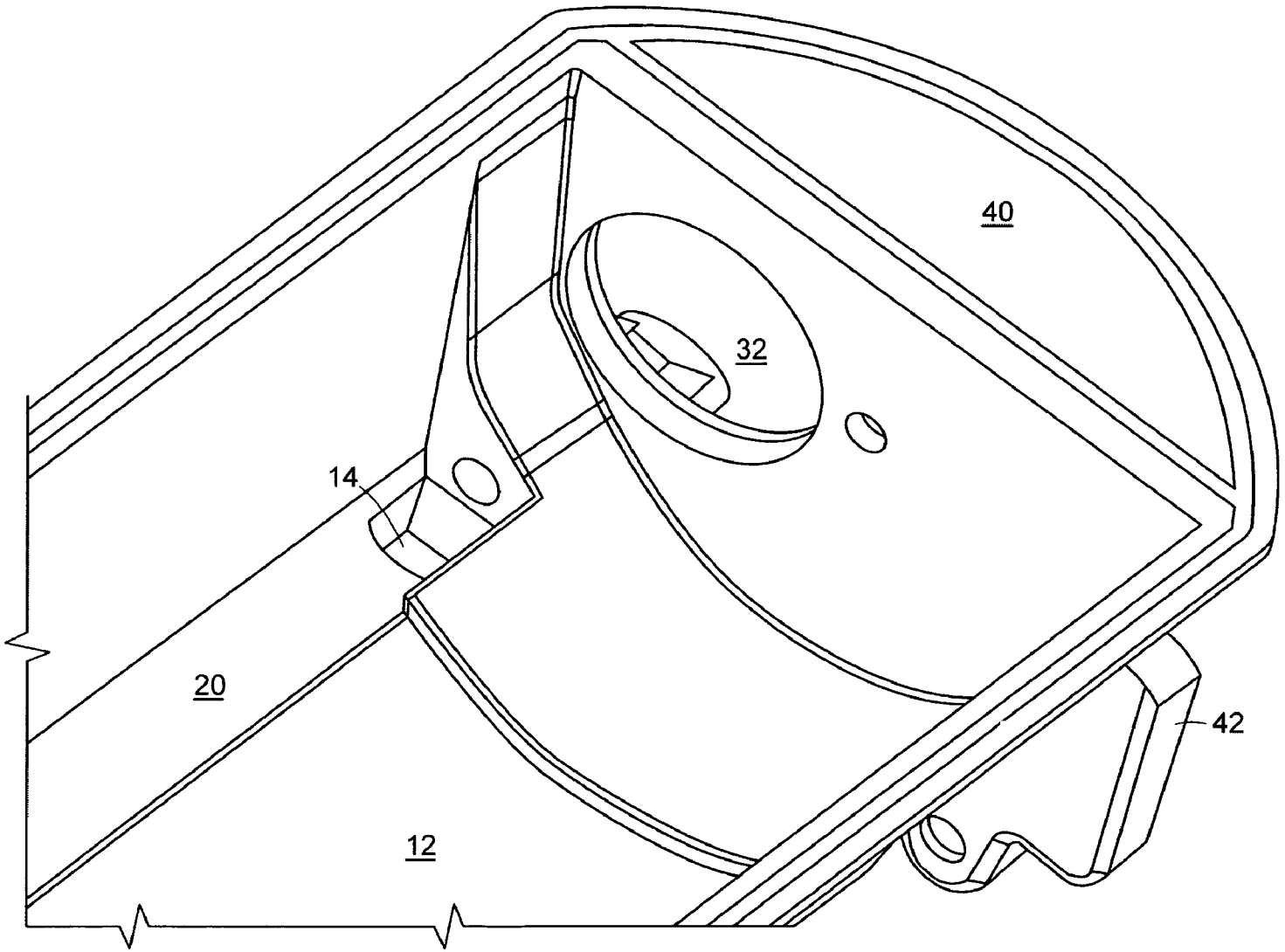
FIG. 5B provides a perspective view of a portion of an embodiment of a toner cartridge with the delivery member removed.

Referring now to FIGS. 5A and 5B, in an embodiment of the invention, the delivery member 16 is disposed in the supply trough 12 of the container 2 within a longitudinal well 20. In this embodiment, the delivery member 16 has a toner feeding member 18 that is shaped like a pocket that holds a certain amount of toner and drops it out of the supply port 14 when the delivery member 16 is rotated. The internal shape of the pocket 18 can be any particular shape but is preferably substantially polygonal, cubic, semi-spherical, semi-cylindrical, or semi-conical. The external shape of the pocket 18 or other toner feeding members 18 (e.g., side walls 23) may likewise have any shape but in an embodiment is at least partially cylindrical or flat, or any such shape that will at least partially prevent toner from leaking into the supply port 14, which in upward or closed orientation. Likewise, the shape or size of the supply port 14 can be any particular shape but is preferably substantially polygonal, square, circular, i.e., to match the internal or external shape and size of the toner feeding member 18.

Figure 6A:
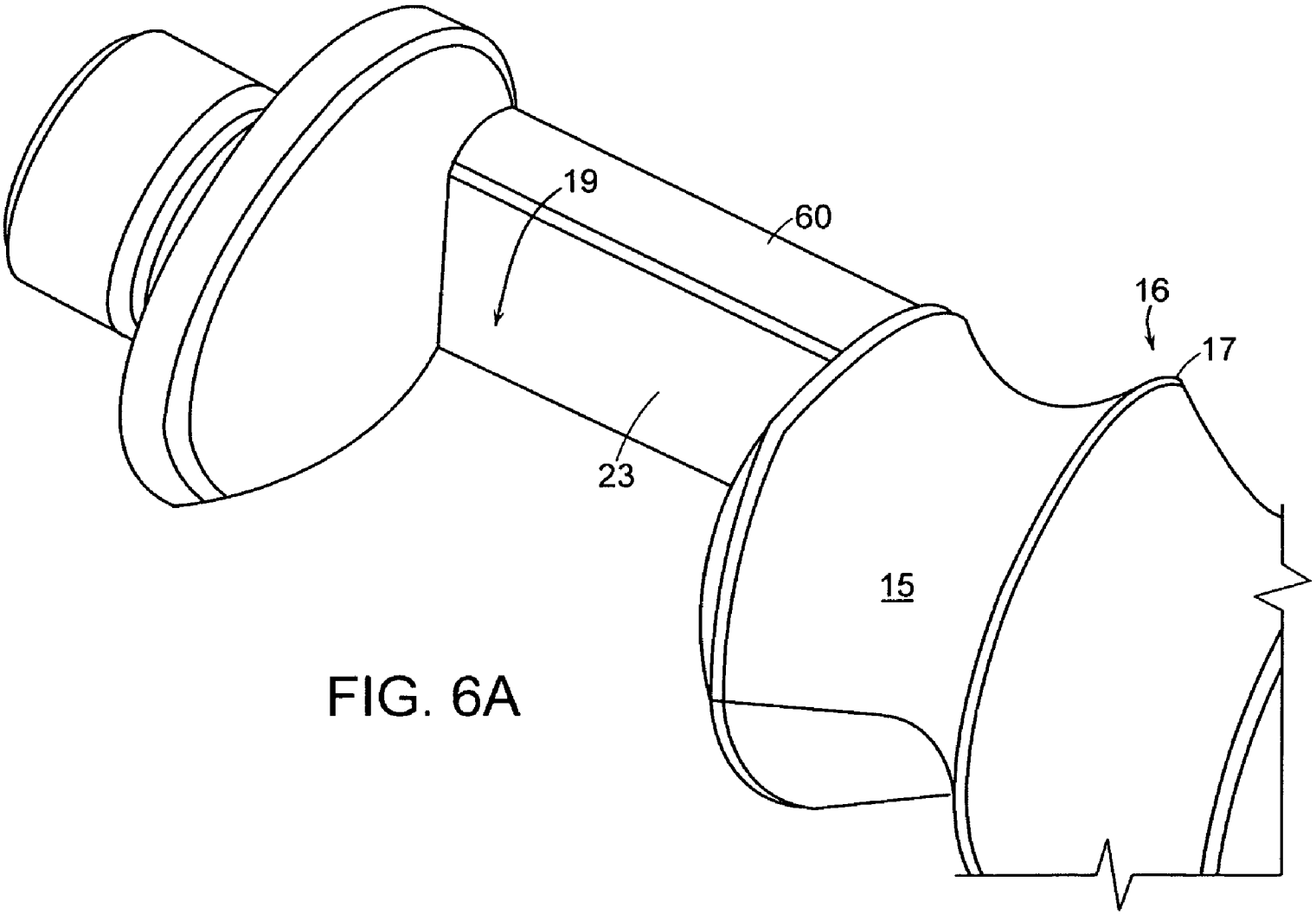
FIG. 6A provides a perspective view of an embodiment of a toner feeding member comprising a channel and one side wall.
Figure 6B:
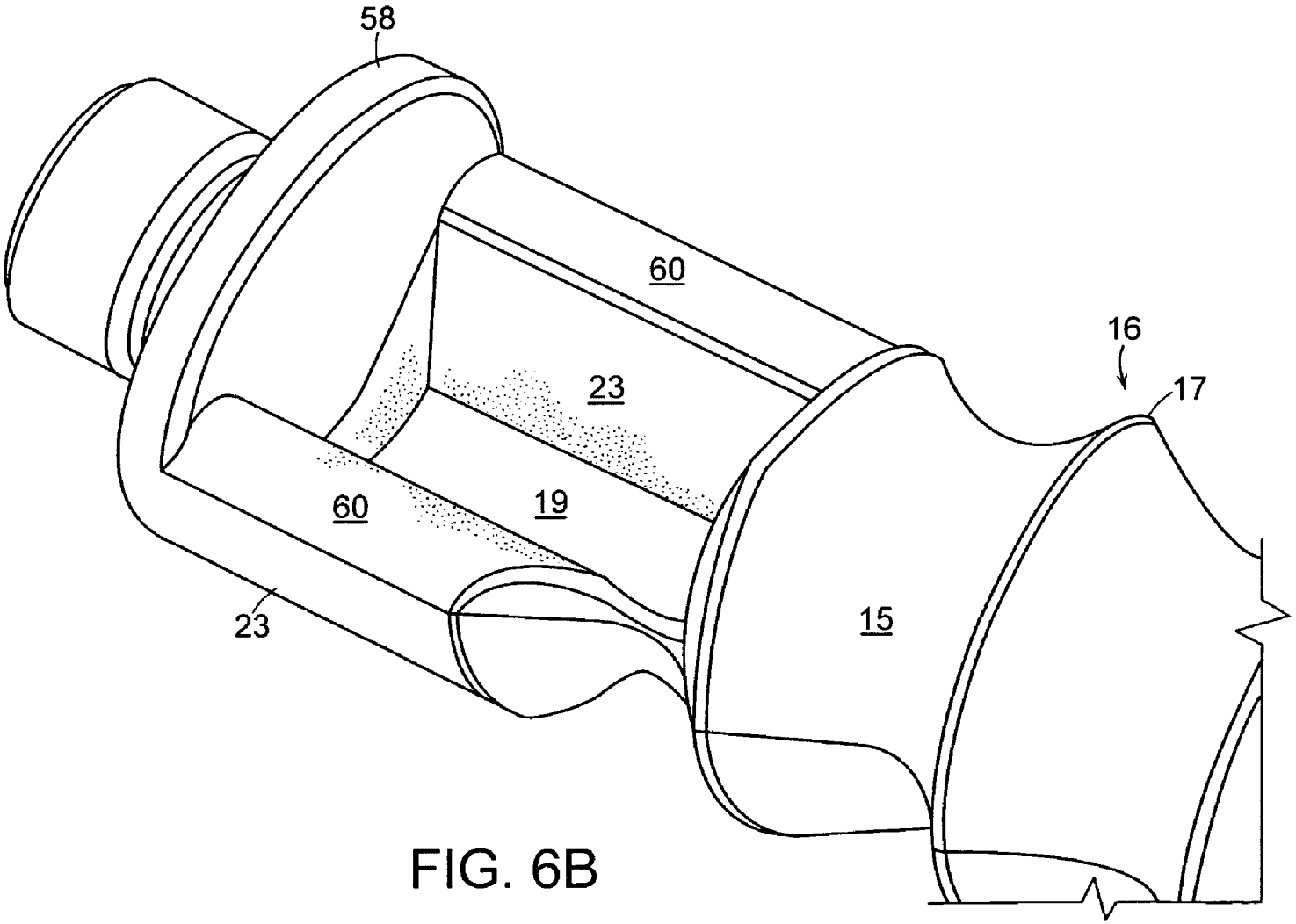
FIG. 6B provides a perspective view of an embodiment of a toner feeding member comprising a channel and two side walls.
Figure 6C:
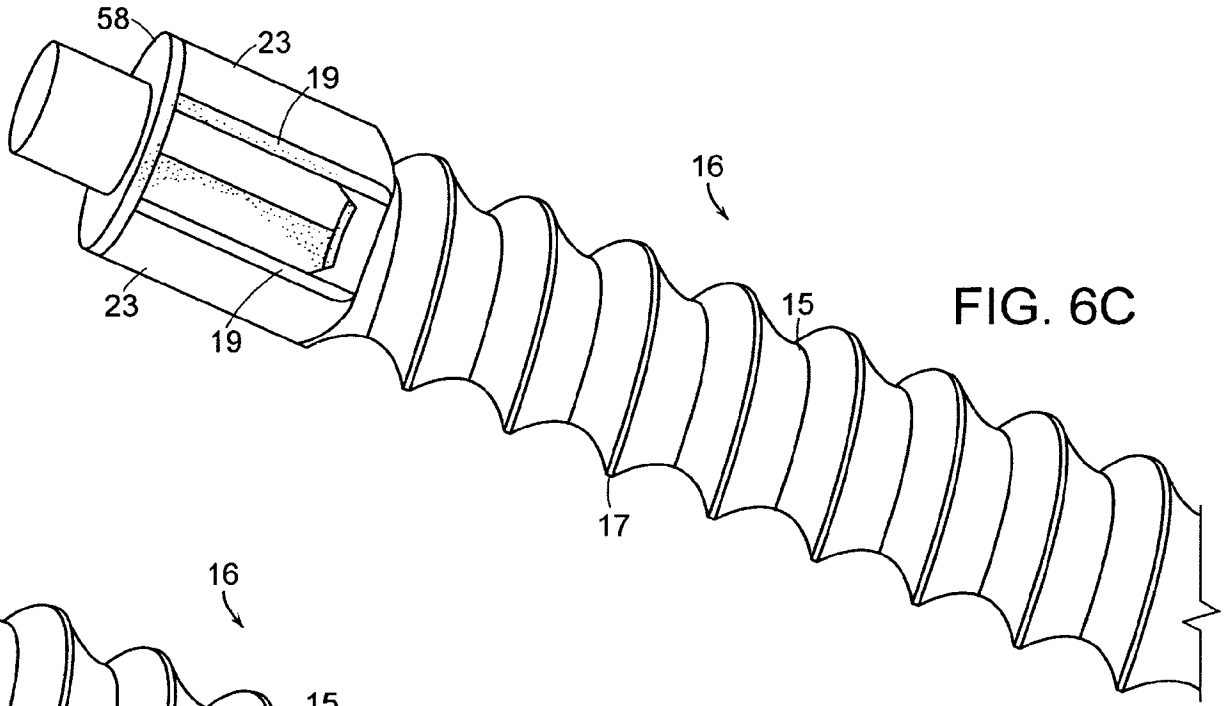
FIG. 6C provides a perspective view of an embodiment of a toner feeding member comprising three side walls and a channel.
Figure 6D:
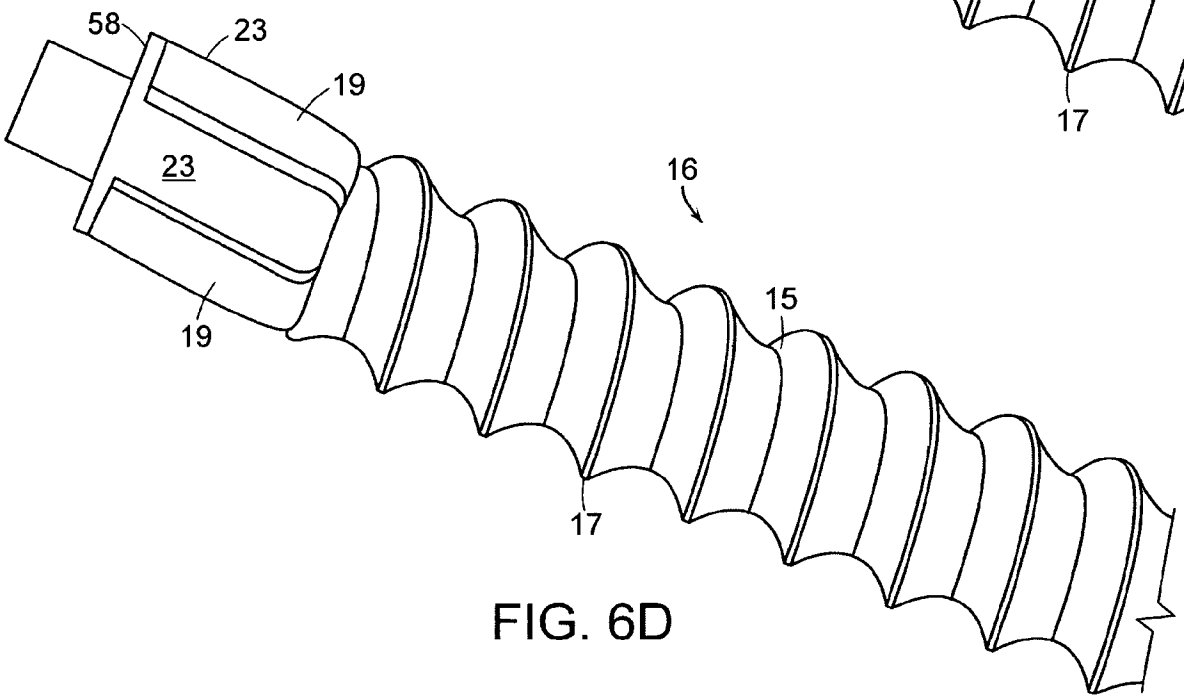
FIG. 6D provides a perspective view of the toner feeding member of FIG. 6C rotated about 60 degrees.
Figure 6E:
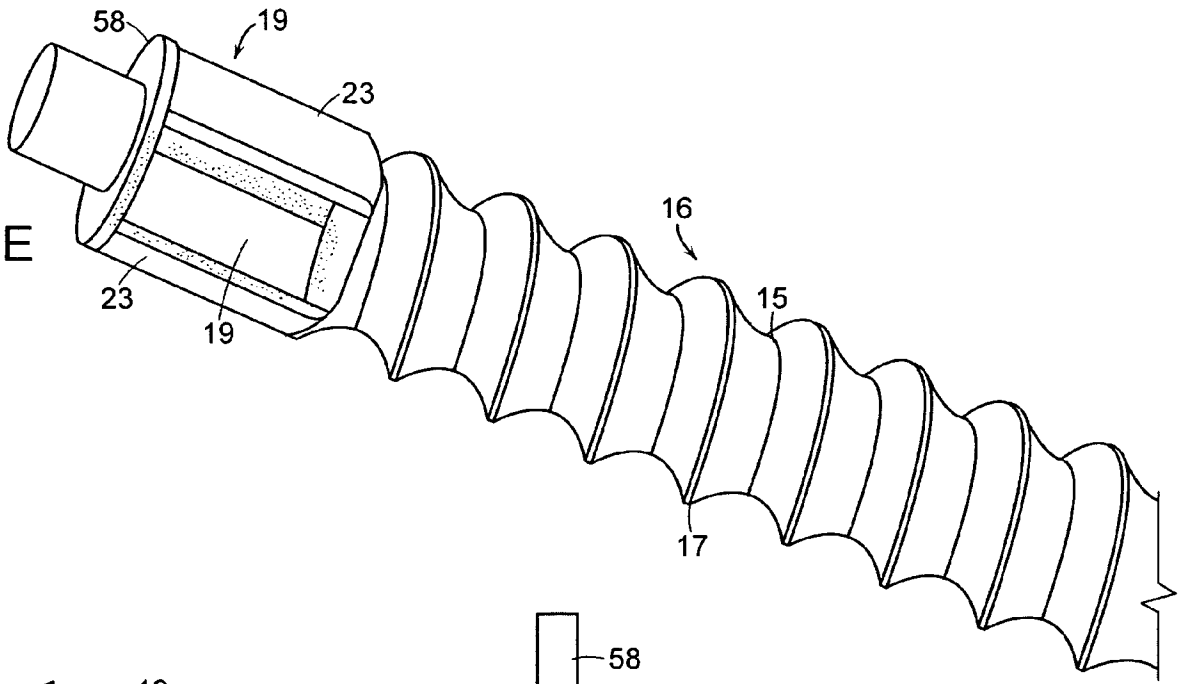
FIG. 6E provides a perspective view of the toner feeding member of FIG. 6C rotated about 20 degrees.

FIGS. 6A to 6E show various embodiments of a toner feeding member 18. Referring to FIG. 6A, the toner feeding member 18 comprises a channel 19 that passes through at least part of the diameter or rotational axis of the delivery member 16, a circumferentially disposed side wall 23, and an end wall 58. FIG. 6B shows a toner feeding member 18 comprising a channel 19 that passes through at least part of the diameter or rotational axis of the delivery member 16, surrounded by two side walls 23, and an end wall 58. FIGS. 6C-6E show another embodiment of a toner feeding member 18 that comprises a channel 19 that passes through at least part of the diameter or rotational axis of the delivery member 16, three side walls 23, and an end wall 58. In the above embodiments, toner passes by gravitational pull through the channel 19 and the supply port 14 when the channel 19 and the supply port 14 are aligned. Toner flow is restrained when the deliver member 16 is rotated such that one or more of the side walls 23 are aligned with the supply port 14, thereby substantially blocking the supply port 14.

In an embodiment, the side wall(s) 23 are located outside the radial extent of the central shaft 15 of the delivery member 16. In another embodiment, the side wall(s) 23 are substantially in line with the radial extent of the helical blade 17. In yet another embodiment, the side wall(s) 23 are substantially outside the radial extent of the helical blade 17. In embodiments, the side wall(s) 23 are substantially curved or substantially planar. In another embodiment, the toner feeding member 18 comprises an end wall 58, for example, that extends from one point on a side wall 23 and is substantially perpendicular to the rotational axis of the delivery member 16. In another embodiment, the end wall 58 is angled relative to the rotational axis of the delivery member 16.

Figure 6F:
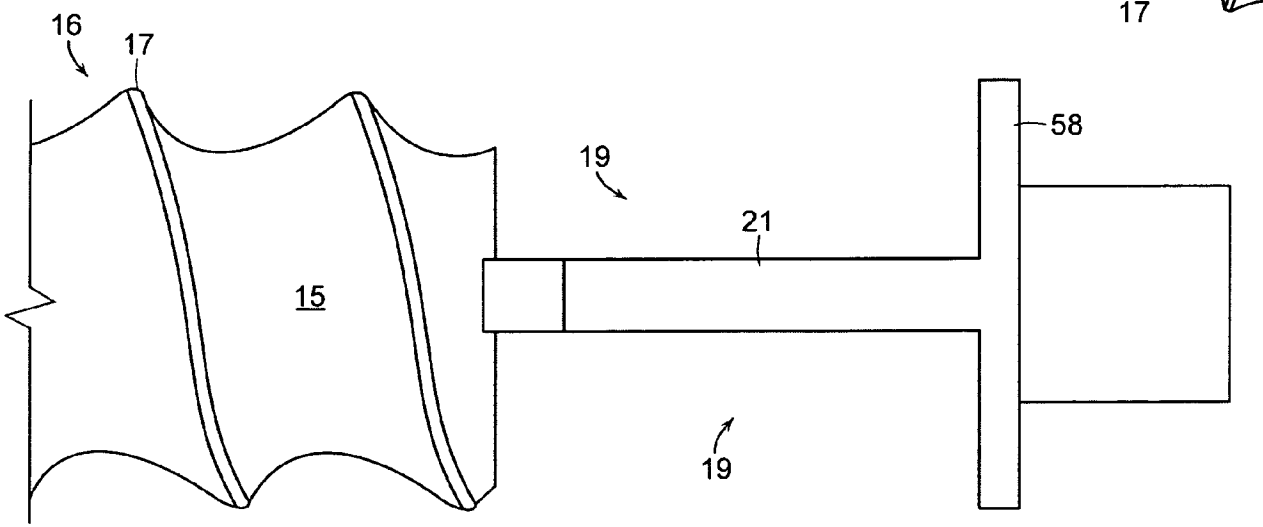
FIG. 6F provides a side view of an embodiment of a toner feeding member comprising a blade and an end panel.
Figure 6G:
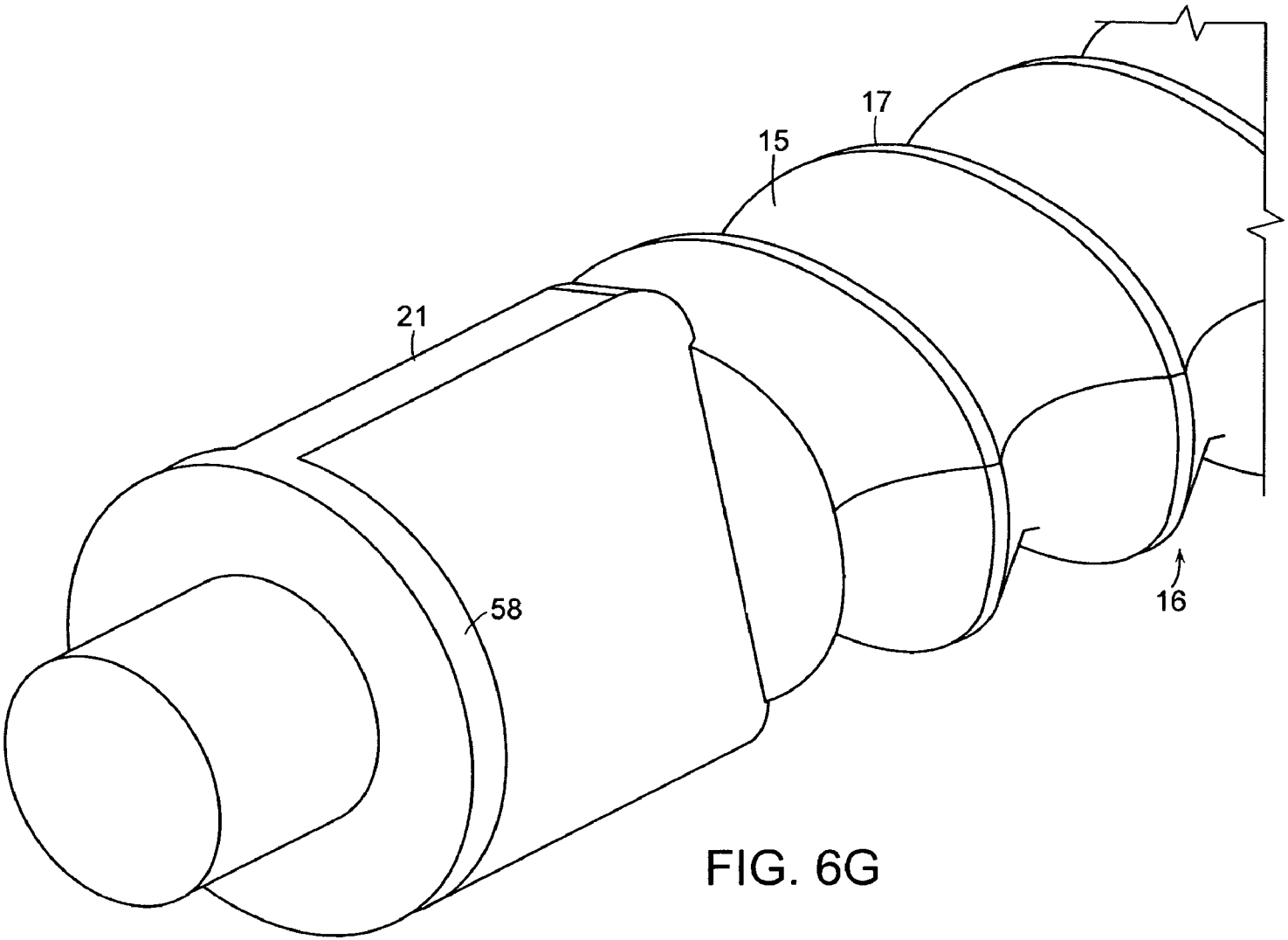
FIG. 6G provides a perspective view of an embodiment of a toner feeding member of FIG. 6F.

Alternatively, FIGS. 6F and 6G show an embodiment of a toner feeding member 18 comprising at least one blade 21 that passes through at least part of the diameter or rotational axis of the delivery member 16 and end wall 58, such that two channels 19 are created though the delivery member 16 for toner to enter the supply port 14 when in an open orientation perpendicular to the opening of the supply port 14 but substantially restraining toner flow when the delivery member 16 is rotated so that the blade 21 is in the closed position, parallel with the opening of the supply port 14. The blade(s) 21 may not pass directly through the rotational axis of the delivery member 16 but create at least one channel 19.

Figure 6H:
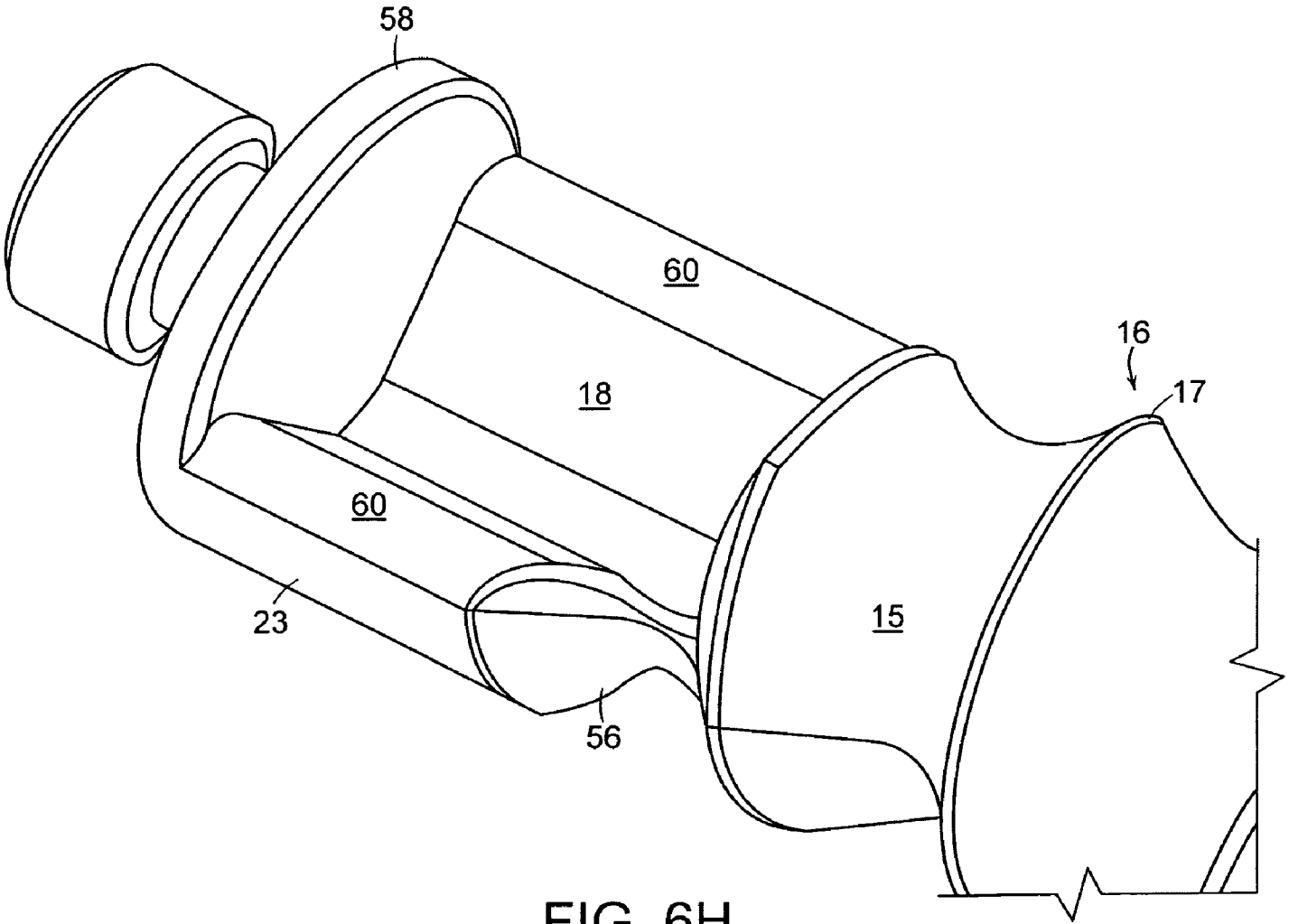
FIG. 6H provides a perspective view of an embodiment of a toner feeding member comprising a pocket with a notch.
Figure 6I:
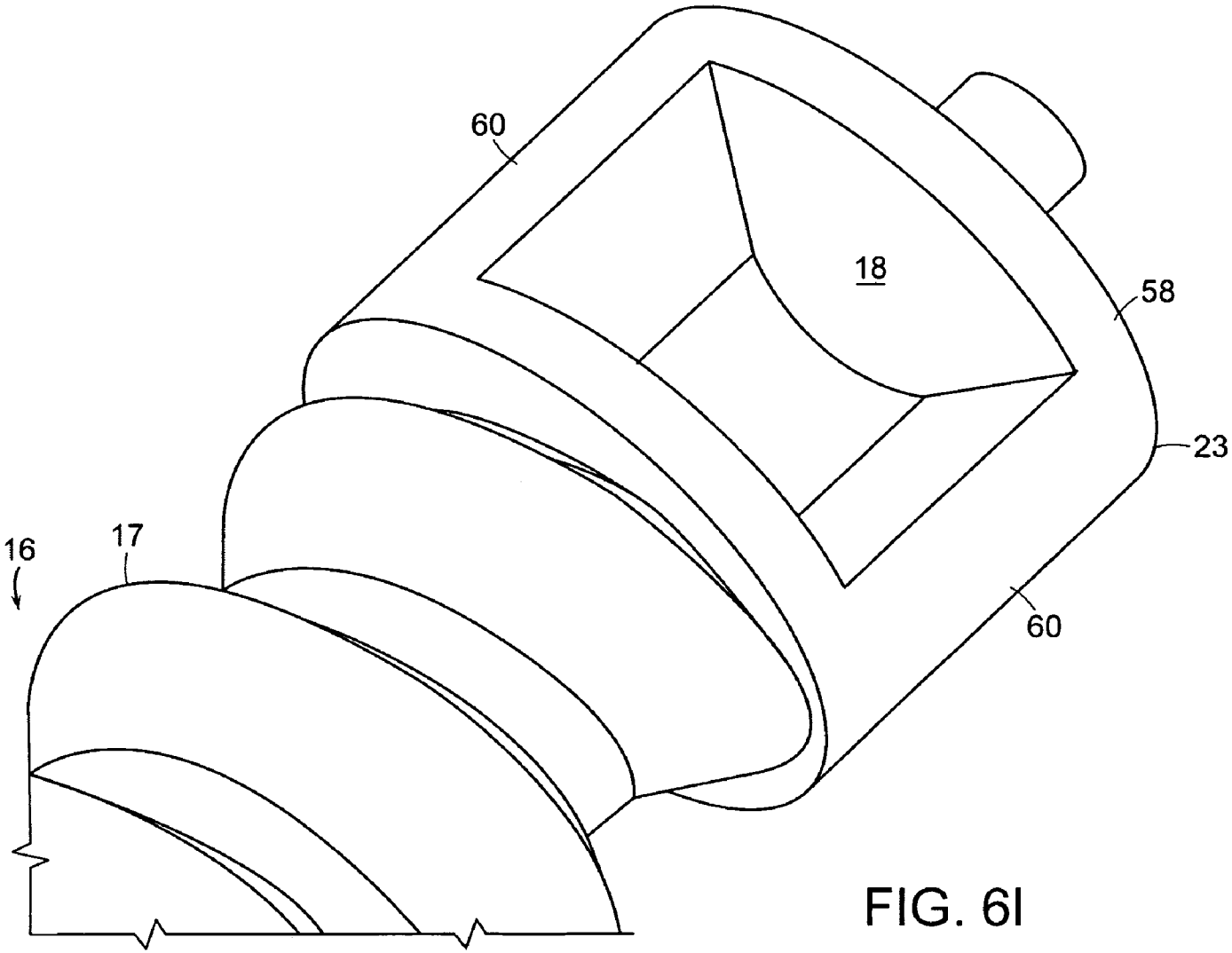
FIG. 6I provides a perspective view of an embodiment of a toner feeding member comprising an enclosed pocket.

Alternatively, FIGS. 6H and 6I show embodiments of a toner feeding member 18 comprising a longer, circumferencially disposed side wall 23, or more than one side wall 23 joined together, that forms a pocket 18. Referring to FIG. 6H, the pocket 18 may comprise a notch 56, such that the helical feeding blade 17 feeds into the pocket 18 and/or may comprise an end wall 58. The embodiment of the toner feeding member 18 shown in FIG. 6I comprises a pocket 18 that does not have a notch 56. The pocket 18 of the invention may comprise substantially sharp or substantially smooth edges 60.

Referring still to FIGS. 6H and 6I, in an embodiment, the depth of the inner or outer surface of the pocket 18 extends past, i.e., is deeper than, the rotational axis of the delivery member 16. For example, the internal depth or diameter of the pocket 18 may extend substantially to the outer radial dimension of the helical feeding blade 17, or beyond. In an embodiment, the walls of the pocket are curved. In another embodiment, the walls of the pocket are substantially planar.

The toner feeding member 18 may be designed to release all or a portion of its toner contents depending upon its rotational position relative to the supply port 14. For example, the toner feeding member 18 may allow unimpeded toner release in an open position (e.g., when aligned with gravitational pull and an open supply port 14) but may restrain toner release when in a closed position (e.g., opposed to gravitational pull or when rotated such that the toner does not have substantial access to the supply port 14, e.g., when the top of the pocket is facing the top of the cartridge 1 and/or the toner supply). Rotation between a fully open and a fully closed position, allows partial (and varying) toner release. For example, referring now to FIGS. 6H and 6I, if the pocket 18 is in a fully open position, the pocket 18 fills with toner. When the pocket 18 is rotated to approach 90° either clockwise or counterclockwise, it begins to release toner into the supply port 14. By the time the pocket 18 is rotated 180° the pocket 18 can empty its contents. As the angle of rotation approaches 270° either clockwise or counterclockwise, the pocket 18 starts to refill with toner. By the time the pocket 18 has rotated a full 360°, the pocket is again full with toner. Alternatively, referring now to FIGS. 6A-6G, if the channel(s) 19 of the toner delivery member 18 is in a fully open position, toner can pass freely through the channel(s) 19 and through the supply port 14. When the toner delivery member 18 is rotated to approach 90° either clockwise or counterclockwise, less toner is able to pass through the channel(s) 19 and into the supply port 14 because the side wall(s) 23 or blade 21 are blocking the supply port 14. As the toner delivery member 18 is rotated toward 180°, it begins to allow toner to pass through the channel(s) 19 and into the supply port 14 until it is in a fully open position again at an angle of rotation of 180°. As the toner delivery member 18 is rotated to approach 270° either clockwise or counterclockwise, less toner is able to pass through the channel(s) 19 and into the supply port 14. As the toner delivery member 18 is rotated toward 360°, it again begins to allow toner to pass through the channel(s) 19 and into the supply port 14 until it is in a fully open position again at an angle of rotation of 360°. In any of the above embodiments, toner may not be completely blocked by the toner delivery member 18 in the closed position and some toner may still pass through the supply port 14. In an alternative embodiment, in any of the above embodiments, toner may be completely blocked by the toner delivery member 18 in the closed position and toner may not pass through the supply port 14.

Figure 7:
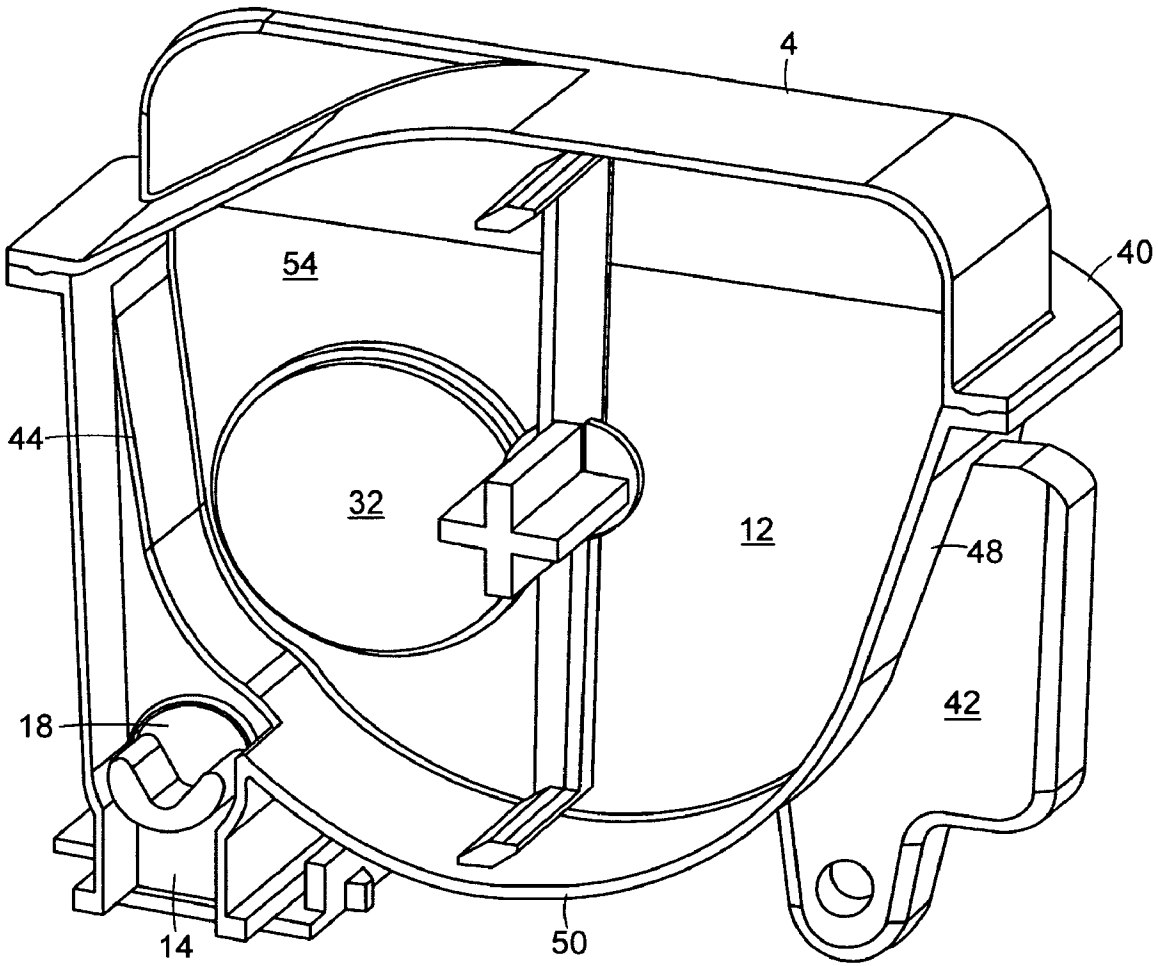
FIG. 7 provides a cross-section of an end of the embodiment of a toner cartridge shown in FIG. 2A, with the pocket in an upright position.

FIG. 7 illustrates a cross-section of an embodiment of the invention in which the pocket 18 is facing upward and can fill with a portion of toner. Rotation of the pocket 18 into the downward position will release a portion of toner to pass through the supply port 14.

Referring again to FIGS. 3A and 3B, insertion of the toner cartridge 1 into an image forming apparatus causes the slide 22 to move from a closed position (FIG. 3A) to an open position (FIG. 3B), thereby opening the supply port 14. In addition, the driving mechanism of the image forming apparatus connects to the drive 28. When the driving mechanism of the image forming apparatus is started, the drive 28 operates to rotate the delivery member 16, which causes the toner feeding member 18, which is full of toner, to deposit toner into the supply port 14. Because the drive gears 10 and 26 are engaged, rotation of the delivery member 16 also causes the stirring member 6 to rotate to stir the toner within the supply trough 12, as well as to feed toner to the supply port 14.

The toner cartridge of the invention may be used with an image forming apparatus, such as an electrophotographic copying machine, or any such image forming apparatus to which a toner cartridge of the invention is mountable.

The toner cartridge and delivery mechanisms and methods described herein are suitable for delivery of any type of powder to an apparatus. For example, the powder may be toner powder, developer powder, a single powder type, or a mixture of more than one type of powder. The term "toner" as used herein includes all types of toner or developer or the like, or mixtures thereof.

The components of the toner cartridge may preferably be produced through injection molding, blow molding, injection blow molding or the like, of a plastic resin material (e.g., high impact polystyrene), but another manufacturing methods and/or materials may be used, for example, single layer material or multiple layer material of polyester, polypropylene, Nylon, metal, polyethylene or fluorine resin material. The toner cartridge and the components thereof may be divided into two or more parts, and the manufactured parts may be welded (e.g., vibration) or bonded to unify them.

Referring again to FIG. 1, the delivery member 16 is not limited to a screw or auger of the illustrated embodiment, but may comprise blades mounted on a shaft, for example. The shaft and the blades may be integrally molded and may be flexible.

The configuration, size, and capacity of the supply trough 12 of the container 2 can be selected properly by one skilled in the art. If the toner amount is as large as approximately 2 kg, for example, the required rotation torque is approximately 1.5 in*lbs, and less as the cartridge is emptied and greater if the toner becomes settled (more dense) during long periods of inactivity.

Referring still to FIG. 1, an assembling method of the toner cartridge 1 is described. In an embodiment, the delivery member 16 is inserted into the well 20 of the container 2 through the top of the container 2. The stirring member 6 is also inserted into the container 2. A predetermined amount of the toner is then filled into the toner supply trough 12 through the opening 32 and the opening closed using plug 34, with the slide 22 covering the toner supply port 14. Alternatively, the toner may be filled through the toner supply port 14 or an additional toner filling port may be formed at a proper portion of container 2 (unshown), and the toner may be filled through the toner filling port, which is then sealed. Further alternatively, the container 2 may be divided into two or more parts, which are joined together after the toner is filled. Where the toner supply port 14 of the integrally formed container 2 is also used as a filling port, no additional cap or joining step after the filling is necessary.

The ratio of the cross-sectional area of the well 20 and the helical feeding blade 17 and toner feeding member 18 of the delivery member 16 is important to ensure proper rotation, proper toner volume in the toner feeding member 18, and to avoid unwanted leakage of toner into the supply port 14. The radius of the well 20 is about 30% larger than the radius of the helical feeding blade 17 (e.g., a well radius of 7.4 mm and a feeding blade radius of 5.8 mm). The minimum percentage would be the radius of the well 20 being about 2% larger than the radius of the feeding blade 17 and the maximum percentage would be the radius of the well 20 being about 200% larger than the radius of the feeding blade 17.

The optimum volume of a pocket 18 is preferably about 0.1 $cm^3$ to about 1.0 $cm^3$. In an embodiment, the pocket 18 holds an amount of toner that is about 10% of an optimum pocket volume to about 400% of an optimum pocket volume, i.e., from about 0.01 to about 4.0 $cm^3$.

The rotational speed of the delivery member 16 is properly selected by one skilled in the art in accordance with the toner feeding amount desired. If the rotational speed is too high the load of the image forming apparatus drive mechanism is increased, and if it is too low the toner cannot be sufficiently fed into the image forming apparatus. Preferably, rotational speed is about 10 to about 230 revolutions per minute, and further preferably, about 110 to about 130 revolutions per minute. In an embodiment, the rotational speed of the delivery member 16 is rotates at about 120 revolutions per minute. This rate may be determined by the particular imaging apparatus into which the cartridge is inserted and may vary from apparatus to apparatus.

If the inner diameter or width of the supply port 14 is too large, toner contamination around the supply port 14 is significant, and the maintenance of the hermeticality during transportation or in the case of ambient condition change, may be compromised. Therefore, the inner diameter or width of the supply port 14 is preferably not more than 40 mm. In an embodiment, the supply port 14 has a polygonal cross-sectional shape and the cross-sectional dimensions are about 10 mm by about 12 mm.

Toner discharging experiments were carried out using the toner cartridge of the invention to determine the amount of torque required to operate the cartridge, to determine a stable toner discharging property (toner discharging amount per unit time), and to determine the amount of toner that remains in the container at the end of the discharge. The initial torque required for the rotation of the stirring member 6 was approximately 1.5 in*lbs. In the experiments, the stirring member 6 comprised polystyrene having a diameter of 79 mm. The container 2 contained approximately 675 g of the toner and the delivery member 16 was rotated at a rate of 120 revolutions per minute to discharge the toner. The delivery member 16 discharges approximately 0.366 grams of toner per revolution; therefore it would generally take approximately 1,844 revolutions to empty the cartridge 1. The cartridge 1 feeds approximately 44 grams of toner per minute to the imaging apparatus. The imaging apparatus generally activates the cartridge 1 when toner is needed (i.e., it does not continually feed toner to the imaging apparatus.

Incorporation by Reference

The contents of all cited references (including literature references, patents, patent applications, and websites) that maybe cited throughout this application are hereby expressly incorporated by reference. The practice of the present invention will employ, unless otherwise indicated, conventional techniques of manufacture of toner cartridges (e.g., plastic molding), which are well known in the art.

Equivalents

The invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims rather than by the foregoing description, and all changes that come within the meaning and range of equivalency of the claims are therefore intended to be embraced herein.

I claim:

1. A toner cartridge for use with an image forming apparatus, the toner cartridge comprising:

a container configured to contain toner;

a supply port through which toner is configured to be supplied to an image forming apparatus; and a delivery member configured to deliver toner to the supply port, the delivery member having a first portion having a helical feeding blade disposed around a central shaft and a second portion having a toner feeding pocket disposed in the central shaft, the toner feeding pocket surrounded by one or more side walls configured to prevent toner from passing from the toner feeding pocket through the supply port when the central shaft is in a first orientation, but configured to allow toner to pass through the supply port when the central shaft is in a second orientation.

2. The toner cartridge according to claim 1, wherein the toner feeding pocket is positioned opposite a toner supply port.

3. The toner cartridge according to claim 1, wherein the container is elongated.

4. The toner cartridge according to claim 1, the container further comprising a supply trough and a lid.

5. The toner cartridge according to claim 1, the container further comprising a well configured to contain the delivery member.

6. The toner cartridge according to claim 1, wherein the supply port is located at an end portion of the toner cartridge.

7. The toner cartridge according to claim 1, wherein the supply port is located at a center portion of the toner cartridge.

8. The toner cartridge according to claim 1, wherein the supply port is located on a bottom portion of the toner cartridge.

9. The toner cartridge according to claim 1, wherein the helical feeding blade is surrounded by two circumferentially disposed side walls.

10. The toner cartridge according to claim 1, wherein the side walls are located outside the radial extent of the central shaft of the delivery member.

11. The toner cartridge according to claim 1, wherein the side walls are substantially in line with a radial extent of the helical blade.

12. The toner cartridge according to claim 1, wherein the side walls are substantially outside a radial extent of the helical blade.

13. The toner cartridge according to claim 1, wherein the side walls are substantially curved.

14. The toner cartridge according to claim 1, wherein the side walls are substantially planar.

15. The toner cartridge according to claim 1, wherein the toner feeding pocket includes at least one channel.

16. The toner cartridge according to claim 1, wherein the toner feeding pocket includes an end wall.

17. The toner cartridge according to claim 1, wherein an end wall extends from one point on a side wall and is substantially perpendicular to a rotational axis of the delivery member.

18. The toner cartridge according to claim 1, wherein the pocket has an internal depth that extends past a rotational axis of the delivery member.

19. The toner cartridge according to claim 1, wherein the toner feeding pocket is configured to hold a volume of toner.

20. The toner cartridge according to claim 19, wherein the volume is about 0.1 $cm^3$ to about 1.0 $cm^3$.

21. The toner cartridge according to claim 1, wherein the toner feeding pocket is configured to obtain an optimum feed rate for supplying toner to the apparatus.

22. The toner cartridge according to claim 1, wherein the toner feeding pocket is configured to obtain an optimum feed rate for supplying toner to the apparatus based upon the number of revolutions per second of the central shaft and a volume of toner held by the toner feeding pocket.

23. The toner cartridge according to claim 1, wherein the toner feeding pocket is configured to hold an amount of toner that is about 10% of an optimum pocket volume to about 400% of an optimum pocket volume.

24. The toner cartridge according to claim 1, wherein the toner feeding pocket is substantially polygonal.

25. The toner cartridge according to claim 1, wherein the toner feeding pocket is one of planar, curved, cubic, semi-spherical, semi-cylindrical or semi-conical.

26. The toner cartridge according to claim 1, wherein the toner feeding pocket is located on an end portion of the delivery member.

27. The toner cartridge according to claim 1, wherein the toner feeding pocket is located on a center portion of the delivery member.

28. The toner cartridge according to claim 1, further comprising a stirring member configured to stir the toner in the cartridge.

29. The toner cartridge according to claim 1, further comprising a movable slide that blocks release of the toner from the toner cartridge when in a closed position but that allows release of the toner from the toner cartridge when in an open position.

30. A toner cartridge for use with an image forming apparatus, the toner cartridge comprising:

a container having a supply trough in communication with a supply port through which toner is supplied to an image forming apparatus; and a delivery member disposed in said supply trough configured to deliver toner to said supply port, said delivery member including a first portion having a helical feeding blade, and a second portion having a toner feeding pocket.

31. The toner cartridge of claim 30, wherein said toner feeding pocket is at least partially defined by one or more side walls.

32. The toner cartridge of claim 31, wherein said delivery member is rotatable between a first orientation such that said toner feeding pocket is in fluid communication with said supply port thereby allowing the toner to pass from said toner feeding pocket to said supply port, and a second orientation such that said one or more side walls are aligned with said supply port thereby substantially blocking the toner from passing to said supply port.

33. The toner cartridge according to claim 30, further comprising a movable slide configured to substantially blocks release of the toner from the toner cartridge when in a closed position and configured to allow release of the toner from the toner cartridge when in an open position.

* * * * *